US007068226B1

(12) United States Patent
Mitra

(10) Patent No.: US 7,068,226 B1
(45) Date of Patent: Jun. 27, 2006

(54) PULSED PLASMA ANTENNA

(75) Inventor: Atindra K. Mitra, Beavercreek, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 156 days.

(21) Appl. No.: 10/810,430

(22) Filed: Mar. 29, 2004

(51) Int. Cl.
*H01Q 1/26* (2006.01)

(52) U.S. Cl. ..... 343/701; 118/723

(58) Field of Classification Search ..... 343/701; 315/111.21; 118/723 E
See application file for complete search history.

(56) References Cited

U.S. PATENT DOCUMENTS

| | | | | |
|---|---|---|---|---|
| 5,648,701 | A | 7/1997 | Hooke et al. | 343/701 |
| 6,118,407 | A | 9/2000 | Anderson | 343/701 |
| 6,465,964 | B1 * | 10/2002 | Taguchi et al. | 315/111.21 |
| 6,492,951 | B1 * | 12/2002 | Harris et al. | 343/701 |
| 6,657,594 | B1 | 12/2003 | Anderson | 315/111.21 |
| 6,830,650 | B1 * | 12/2004 | Roche et al. | 156/345.24 |
| 2002/0122896 | A1 * | 9/2002 | Kim et al. | 427/569 |
| 2005/0034812 | A1 * | 2/2005 | Roche et al. | 156/345.28 |
| 2005/0098117 | A1 * | 5/2005 | DiVergilio et al. | 118/723 E |

* cited by examiner

*Primary Examiner*—Tan Ho

(74) *Attorney, Agent, or Firm*—AFMCLO/JAZ; Gina S. Tollefson; Gerald B. Hollins

(57) ABSTRACT

A method and device of energizing a plasma antenna using power from the discharge of an electopropulsion engine and comprising a propellant and feed system, a capacitor charging power processing unit and an energy storage capacitor, wherein said energy is released over an electrode gap and resultant ablation products are ionized and accelerated by an electromagnetic force, thereby producing a pulse.

12 Claims, 3 Drawing Sheets

PULSED PLASMA ANTENNA

RIGHTS OF THE GOVERNMENT

The invention described herein may be manufactured and used by or for the Government of the United States for all governmental purposes without the payment of any royalty.

BACKGROUND OF THE INVENTION

The invention relates to communication antennas and more specifically to plasma antennas energized with electrical parameters from distributed engine systems.

A plasma is a mixture of positively and negatively charged particles interacting with an electromagnetic field which dominates their motion and in which high temperatures may be reached. Plasma can be utilized as energy sources in many useful applications, such as antennas. In known plasma systems, gases are typically raised to a very high temperature by applying radio frequency power from an alternating current source to a coil encircling a working gas which is partially ionized. A magnetic field is useful for controlling the charged particles in a plasma by keeping them along field lines.

Conventional plasma antennas are of interest in communication systems since the frequency, pattern and magnitude of the radiated signals are proportional to the rate at which ions and electrons are displaced. The displacement and hence the radiated signal can be controlled by a number of factors including plasma density, tube geometry, gas type, current distribution, applied magnetic field and applied current. This allows the plasma antenna to be physically small, in comparison with traditional antennas.

A number of advanced and alternative propulsion concepts within the scientific and research community have been formulated for meeting the challenges of future aerospace applications. Many of these advanced propulsion concepts fall under the categories of chemical propulsion, nuclear thermal propulsion, and electric propulsion along with some hybrid concepts also. For the present invention, advanced electrical propulsion techniques are considered as the preferred arrangement of the invention due to the potential for closely controlling the properties of the "engine plasma discharge". A number of novel and promising electronic propulsion techniques have been surveyed in the literature including Hall thrusters, ion thrusters, and pulsed plasma thrusters.

The idea of integrating plasma antenna concepts with distributed engine concepts shows potential for the development of integrated lightweight and agile antenna structures that can be reconfigured and "re-tuned" to meet the specifications of a variety of different real-time applications. For example, recent interest for the development of mini and micro UAV (Unmanned Aerial Vehicle) platforms for intelligence applications requires intensive analysis of size, weight, aperture, and power (SWAP) constraints in order to implement desired and enhanced capabilities on size-limited platforms. Integration of propulsion with avionics functions will lead to major breakthroughs towards the development of systems with these challenging SWAP constraints.

In addition, maturation of this new method for the development of plasma antennas will lead to future breakthroughs in antenna technologies. Some of these breakthroughs in technology will be realized by investigating and developing (inducing) additional electromagnetic propagation modes, for example, by reconfiguring the distributed electropropulsion system that is described in this disclosure to develop enhanced radar and communications capabilities over, for example, larger bandwidths.

For purposes of visualizing this integrated systems concept, FIG. 1 shows a NASA blended-wing prototype at 3% scale. In FIG. 1, the blended wing is shown at 101. In prototype of FIG. 1, the engines are shown at 100. The distributed engine system, 100, can be designed and implemented to function as a plasma antenna array. This type of plasma antenna implementation can be realized via developments in advanced joint propulsion and radiation propagation/scattering analysis and design techniques as disclosed in the description of the invention.

SUMMARY OF THE INVENTION

A method and device of energizing a plasma antenna using power from the discharge of an electopropulsion engine and comprising a propellant and feed system, a capacitor charging power processing unit and an energy storage capacitor, wherein said energy is released over an electrode gap and resultant ablation products are ionized and accelerated by an electromagnetic force, thereby producing a pulse.

It is therefore an object of the invention to provide an integrated approach to air vehicle design with enhanced capabilities.

It is another object of the invention to provide a method and device for energizing a plasma antenna.

It is another object of the invention to provide a method and device for energizing a plasma antenna using power from the discharge of an electropropulsion engine.

It is another object of the invention to provide a method and device for energizing a plasma antenna using power from the discharge of an electropropulsion engine comprising a propellant and feed system, a capacitor charging power processing unit and an energy storage capacitor, wherein said energy is released over an electrode gap and resultant ablation products are ionized and accelerated by an electromagnetic force, thereby producing a pulse.

These and other objects of the invention are described in the description, claims and accompanying drawings and are achieved by a method of energizing a plasma antenna using power from the discharge of an electopropulsion engine comprising the steps of:

providing a solid bar of Teflon contacting an electrode with said solid bar of Telfon;

charging a capacitor using a power processing unit;

firing a spark ignitor to create an initial conducting path for a primary discharge.

discharging electromagnetic particles initiatied by pulse forming circuitry;

releasing energy from said capacitor across said electrode gap; and ablating several layers of said Teflon bar, said ablation products ionizing and accelerating by an electromagnetic Lorenz force, thereby generating a pulse.

DETAILED DESCRIPTION

A number of advanced and alternative propulsion concepts within the scientific and research community have been formulated for meeting the challenges of future aerospace applications. Many of these advanced propulsion concepts fall under the categories of chemical propulsion, nuclear thermal propulsion, and electric propulsion along with some hybrid concepts also. For the present invention, advanced electrical propulsion techniques are considered as a preferred arrangement of the invention due to the potential for closely controlling the properties of the "engine plasma discharge". However, a number of novel and promising electric propulsion techniques including Hall thrusters, ion thrusters, and pulsed plasma thrusters may be employed in the device and method of the invention.

Figure 1:
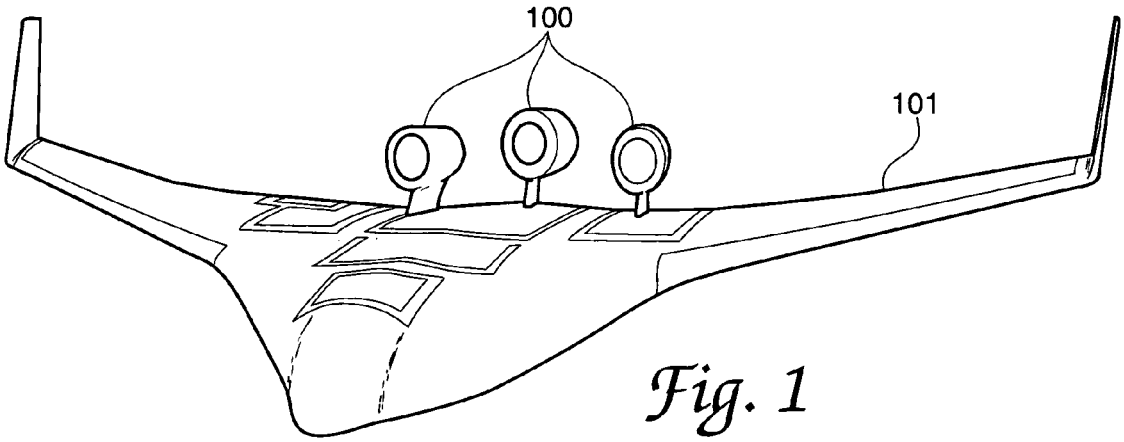
Fig. 1 PRIOR ART
FIG. 1 shows a prior art NASA blended wing prototype.
Figure 2:
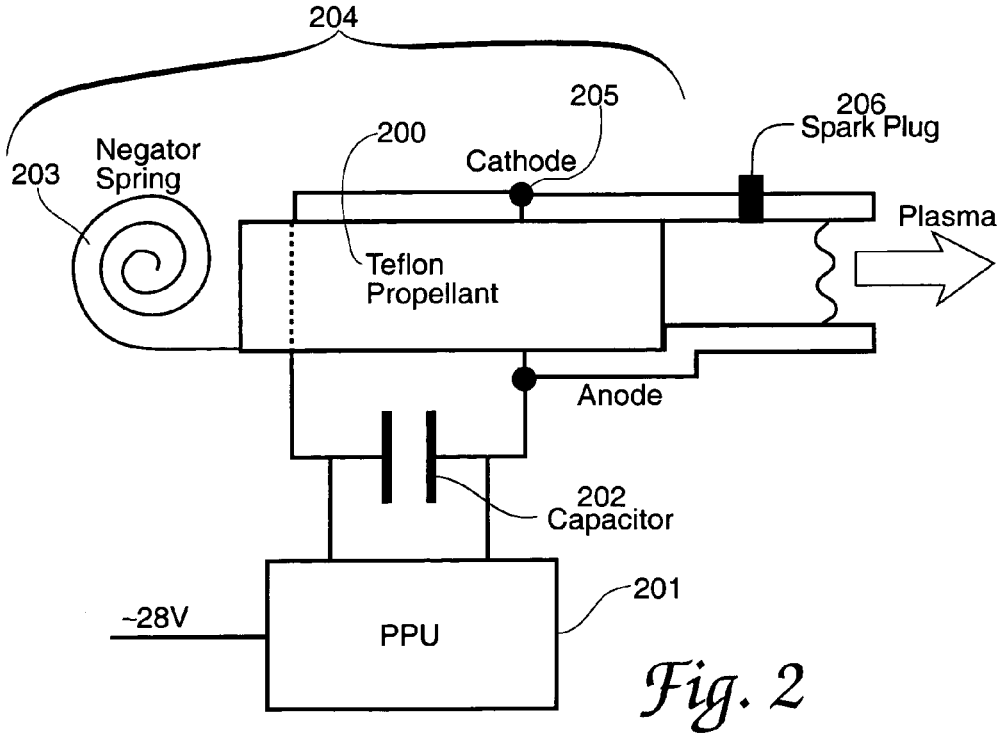
FIG. 2 shows a block diagram of a micro pulsed plasma thruster.

FIG. 2 illustrates a block diagram for a Micro Pulsed Plasma Thruster (PPT). This sub-category of electric propulsion was developed for miniature satellite applications and shows potential for application into recent military initiatives for unmanned air vehicle development efforts including mini-unmanned air vehicle applications. The three basic elements of the PPT are the propellant and feed system 204, a power processor 201, and an energy storage capacitor 202. The propellant 200 for this PPT is a compact solid bar of Teflon along with a "negator spring" 203. As a few layers of the Teflon surface are removed with each shot, the negator spring 203 (which is the only moving part) pushes the bar 200 up to the electrodes 205 in preparation for the next shot. The power processing unit (PPU) 201 uses power from an aerospace platform to charge a capacitor 202. Once the capacitor 202 is charged, a spark ignitor 206 is fired to create an initial conducting path for the primary discharge.

The pulse forming circuitry which is also part of the PPU, 201 in FIG. 2, then initiates the primary discharge which releases the energy from the capacitor (tens of Joules) across the electrode gap over a time scale of several microseconds. The current across the electrodes during the discharge is on the order of tens of kiloamperes and results in the ablation of several layers of the Teflon bar. During the discharge, these ablation products, which consist of a variety of molecular fluorocarbons, are ionized and then accelerated by a electromagnetic Lorentz force to a velocity of 10–20 km/sec. The thrust generated during a single pulse is on the order of tens to hundreds of micronewtons; because the pulse duration is on the order of microseconds, the capacitor can be charged and fired several times per second producing average thrust in the micronewton to millinewton range. The low thrust per pulse results in the ability of the PPT to deliver very small impulse bits which are desirable for applications that require precision maneuverability.

The state-of-the-art PPT has a specific impulse of 800–1500 $lb_f$-s/$lb_m$, thrust of 220–1100 mN, efficiency of 5–15% and a total wet mass of less than 5 kg. With a given capacitor and electrode geometry, the thrust level can be varied over a wide range at the same specific impulse by varying the pulse frequency (typically 1–3 Hz). The capacitor is designed to deliver 20 million pulses at 40 Joules/pulse. It is well suited for use on small aerospace platforms, operating at power levels of 20–160 W and able to deliver impulse bits as low as 10 μN-sec.

Figure 3:
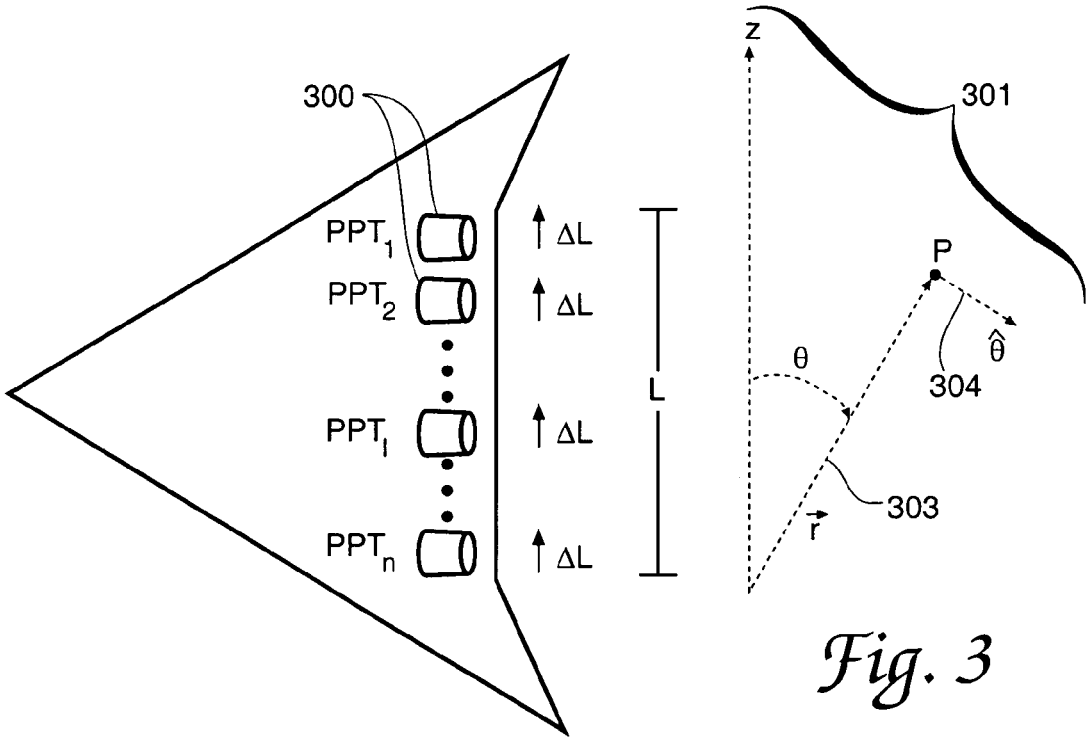
FIG. 3 shows a geometrical sketch of a plasma antenna array system.
Figure 4:
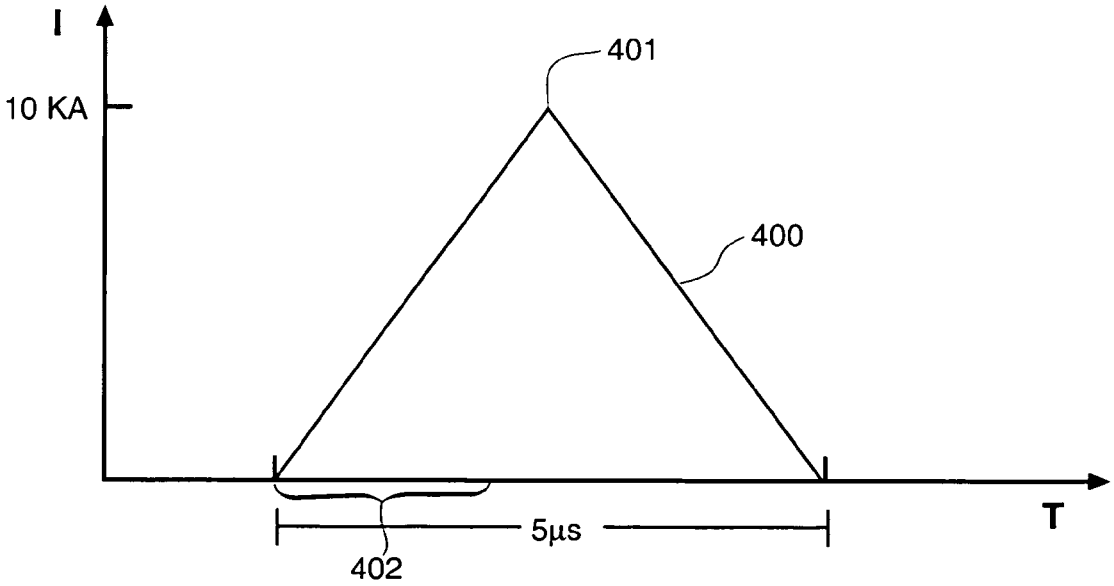
FIG. 4 shows a notational sketch of a plasma discharge current in each PPT of FIG. 3.

A geometrical sketch of a distributed propulsion system with integrated plasma antenna array design is shown in FIG. 3. Distributed plasma pulsed thrusters are shown at 300. For purposes of illustrating the functionality of this new plasma antenna array concept, consider the capacitor discharge and the "plasma discharge" cycle, illustrated by the geometry at 301 in FIG. 3. The "plasma (or electrode) current" 303 increases while the capacitor is discharging 303. After the capacitor discharges through the electrode gap, the "plasma current" decays 304 via recombination of plasma ions with neighboring atoms. In order to observe the basic features of this system, the "plasma current" is modeled as a linear build-up and linear decay and is expressed as the triangle function in Eq. 1 and is also sketched in FIG. 4. This equation represents a notional triangular current pulse, shown generally at 400, with a peak value of 10 KA, illustrated at 401, a rise-time of 2.5 μs, illustrated at 402, and a decay time of 2.5 μs.

$$TRI(t) = 10KA * \left(1 - \left|\frac{t}{2.5\mu s} - 1\right|\right), \quad \text{for} \left|\frac{t}{2.5\mu s} - 1\right| < 1 \qquad \text{Eq. 1}$$

$$= 0 \qquad , \text{ for} \left|\frac{t}{2.5\mu s} - 1\right| \geq 1$$

The radiated waveform for this system configuration (with identical and linear "plasma discharge" pulses on each PPT of FIG. 3) can be modeled with Eq. 2 as follows:

$$\vec{E}_r(t) = \qquad \text{Eq. 2}$$

$$\frac{\mu_0 c \sin\theta}{4\pi r}\left\{\sum_{i=1}^{n}\left(\frac{\Delta L}{c}\right) * \frac{d}{dt} TRI\left[t - \frac{r}{c} - \left(i - \frac{1}{2}\right)\left(\frac{\Delta L}{c}\right)(1 - \cos\theta)\right]\right\}\vec{\theta}$$

Figure 5A:
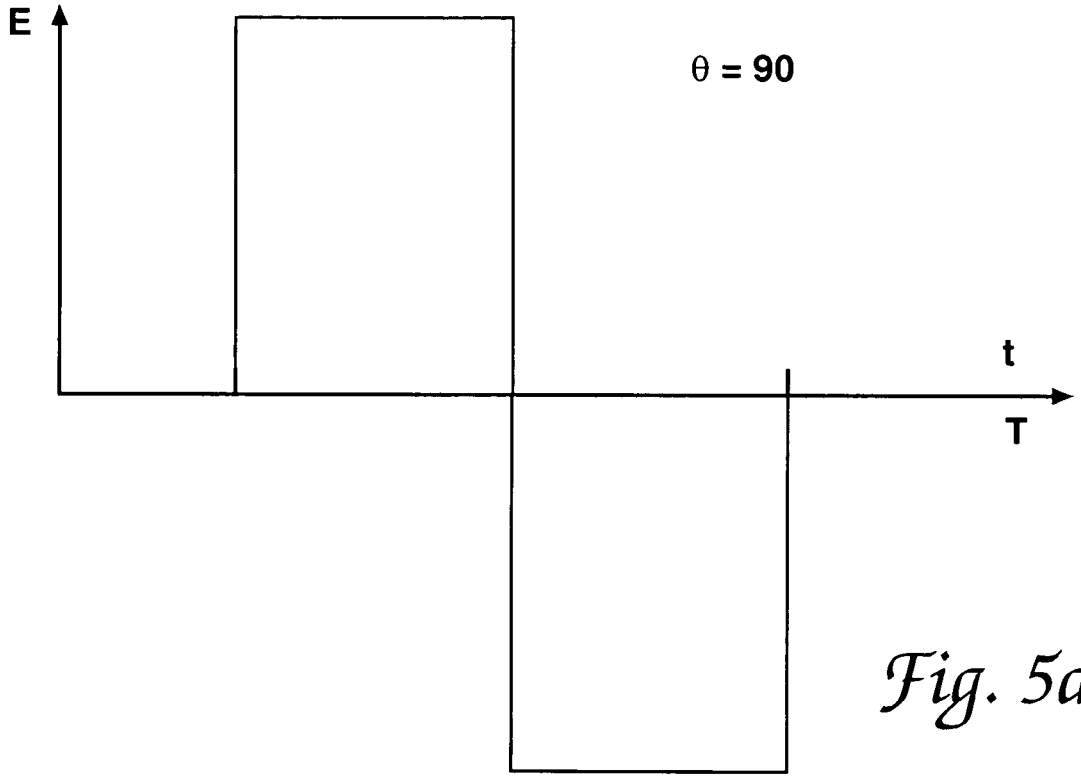
FIG. 5*a* shows a notational sketch of a radiated pulse waveform at an angle of 90 degrees.
Figure 5B:
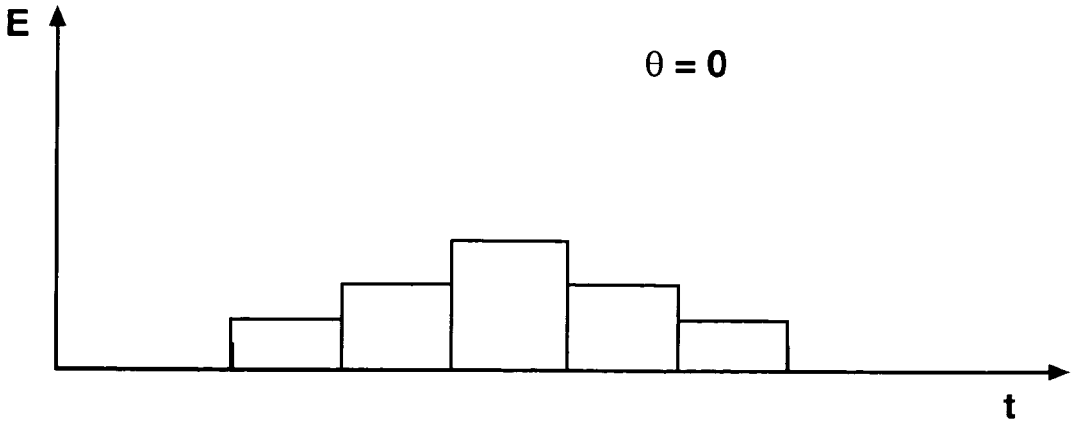
FIG. 5*b* shows a notational sketch of radiated pulse waveform at an angle of zero degrees.

With this approach, the current distribution for each PPT discharge is approximated as a filamentary dipole current where the filamentary dipoles differentiate the triangular pulses with respect to time thereby generating a short pulse for the broadside far field pattern of the distributed engine array. FIG. 5*a* illustrates a notional sketch of a radiated pulse waveform at an angle of 90 degrees. The identical triangular pulses do not coherently sum in the off-broadside far field region. FIG. 5*b* illustrates a notional sketch of a radiated pulse waveform at an angle of 0 degrees. A "staircase-like" function similar to the waveform of FIG. 5*b* is generated for an off-broadside angle of 0 degrees. Since the nature of these staircase functions of FIG. 5*b* vary as a function of angle, this antenna pattern exhibits a type "spacio-temporal" modulation. In addition to the other potential benefits of developing plasma antenna systems, this type of directional or "spacio-temporal" modulation can be exploited for a number of applications. For example, this type of system can be employed as a new multi-platform multi-user technique where mutual interference signals between users on different platform sets are rejected via this type of spacio-temporal modulation. Additional applications include "co-location awareness" between multiple platforms where each platform can locate itself with respect to other platforms (within a network of air vehicle platforms) by using spatio-temporal modulation.

With this in mind, many additional degrees of freedom can be obtained by addressing the challenging system development problem of designing non-identical "plasma discharge" waveforms that vary in real-time from engine to engine. Since this implementation is with distributed electric propulsion systems, many of the challenges of implementing this type of highly flexible system can be addressed by incorporating electronic system control mechanisms that preserve the coherence between diverse engine-to-engine transmitter configuration while at the same time maintaining the real-time thrust requirements of the overall distributed engine configuration as a function of desired aerodynamic maneuvers.

Distributed electric engine configurations that are compatible with the development of integrated plasma antenna designs are presented as a new system-of-systems concept. This general approach opens the door for the investigation of a number of additional systems concepts that fall under the same basic architecture. For example, electric engine designs for this type of plasma antenna application can be developed that excite a much larger diversity of frequency modes. One such approach to exciting more propagation modes is to mutually vary the "tilt angle" between the cathode, the anode, and the propellant to investigate the effects of oblique incidence between the electromagnetic source and the plasma. In addition, a number of schemes can be formulated for modulating the signal on the electromagnetic source to gain for signal diversity of communications applications. These distributed engine configurations show good potential for implementing significant integrated plasma antenna capabilities that lead to advances in lightweight high-throughput and broadband communications, radar, and electronic warfare systems.

While the apparatus and method herein described constitute a preferred embodiment of the invention, it is to be understood that the invention is not limited to this precise form of apparatus or method and that changes may be made therein without departing from the scope of the invention which is defined in the appended claims.

What is claimed is:

1. A method of energizing a plasma antenna using power from the discharge of an electropropulsion engine comprising the steps of:

providing a solid bar of polytetrafluoroethene;

contacting an electrode with said solid bar of polytetrafluoroethene;

charging a capacitor using a power processing unit;

firing a spark ignitor to create an initial conducting path for a primary discharge;

discharging electromagnetic particles initiated by pulse forming circuitry;

releasing energy from said capacitor across said electrode gap;

ablating several layers of said polytetrafluoroethene bar, said ablation products ionizing and accelerating by an electromagnetic Lorenz force, thereby generating a pulse.

2. The method of energizing a plasma antenna claim 1 wherein said releasing step further comprises releasing energy from said capacitor in the amount of tens of Joules.

3. The method of energizing a plasma antenna of claim 2 wherein said releasing step further comprises releasing energy from said capacitor in an amount of tens of Joules over a time scale of several microseconds.

4. The method of energizing a plasma antenna of claim 1 wherein said charging step further comprises charging a capacitor using power from an aerospace platform.

5. The method of energizing a plasma antenna of claim 1 wherein said ablating step further comprises ablating several layers of said polytetrafluoroethene bar, said ablation products ionizing and accelerating by an electromagnetic Lorenz force to a velocity of 10–20 km/sec.

6. The method of energizing a plasma antenna of claim 1 wherein said ablating step further comprises ablating several layers of said polytetrafluoroethene bar, said ablation products including a variety of molecular fluorocarbons, ionizing and accelerating by an electromagnetic Lorenz force, thereby generating a pulse.

7. The method of energizing a plasma antenna of claim 1 wherein said ablating step further comprises ablating several layers of said polytetrafluoroethene bar, said ablation products ionizing and accelerating by an electromagnetic Lorenz force, thereby generating a pulse of short duration.

8. A plasma antenna system comprising:

a propellant and feed system;

a capacitor charging power processing unit;

an energy storage capacitor, wherein said energy is released over an electrode gap and resultant ablation products are ionized and accelerated by an electromagnetic force, thereby producing a pulse.

9. The plasma antenna system of claim 8 wherein said propellant and feed system is a compact solid bar of polytetrafluoroethene and a negator spring.

10. The plasma antenna system of claim 8 wherein said capacitor charging power processing unit uses power from an aerospace platform.

11. The plasma antenna system of claim 8 wherein said plasma antenna is a directional modulation plasma antenna.

12. The plasma antenna system of claim 8 further comprising a spark ignitor for creating an initial conducting path for primary discharge.

* * * * *